US006568649B1

(12) United States Patent
Schmitt

(10) Patent No.: US 6,568,649 B1
(45) Date of Patent: May 27, 2003

(54) TRAINLINE SUPPORT BRACKET

(75) Inventor: Eugene W. Schmitt, Lockport, IL (US)

(73) Assignee: Strato, Inc., Piscataway, NJ (US)

( * ) Notice: Subject to any disclaimer, the term of this patent is extended or adjusted under 35 U.S.C. 154(b) by 0 days.

(21) Appl. No.: 09/997,798

(22) Filed: Nov. 30, 2001

(51) Int. Cl.[7] ..... F16M 13/00
(52) U.S. Cl. ..... 248/551; 213/75 R
(58) Field of Search ..... 248/200, 551, 248/552, 553; 70/232, DIG. 57; 403/150, 152, 154, 157, 155; 213/75 R, 88, 98, 86, 115, 118; 411/999

(56) References Cited

U.S. PATENT DOCUMENTS 3,104,017 A * 9/1963 Kulieke et al. ..... 213/61
3,467,422 A * 9/1969 Mielke ..... 287/100
3,600,047 A * 8/1971 MacDonnell ..... 384/39
3,646,604 A * 2/1972 Tack et al. ..... 105/4.3
4,298,298 A * 11/1981 Pontone ..... 411/342
4,597,499 A * 7/1986 Hanula ..... 213/50.5
4,623,050 A * 11/1986 Copp ..... 188/250 F
4,706,826 A * 11/1987 Elliott et al. ..... 105/420
4,846,358 A * 7/1989 Rhen ..... 213/64
4,889,458 A * 12/1989 Taylor ..... 403/156
5,507,400 A * 4/1996 Long et al. ..... 213/62 A
5,598,936 A * 2/1997 Murphy ..... 213/61
6,095,350 A * 8/2000 Sauer et al. ..... 213/19

* cited by examiner

*Primary Examiner*—Ramon O. Ramirez
*Assistant Examiner*—Kofi Schulterbrandt
(74) *Attorney, Agent, or Firm*—Cook, Alex, McFarron, Manzo, Cummings & Mehler, Ltd.

(57) ABSTRACT

A trainline support bracket and a fastener for mounting the bracket to a rail car coupler assembly which includes spaced, downwardly extending mounting extensions having aligned bores therein, with the bracket including a pair of upwardly extending arms, spaced apart a distance to be positioned directly outside of the mounting extension. The openings in each of the upwardly extending arms are aligned with bores in the extensions. A headed bolt extends through the aligned bores and openings to attach the bracket to the coupler assembly. A nut is threaded on the bolt. The specific improvement of the present invention is a retainer which is attached to the bolt and bracket and prevents removal of the bolt from the aligned openings and bores even if the nut is removed from the bolt.

9 Claims, 2 Drawing Sheets

TRAINLINE SUPPORT BRACKET

THE FIELD OF THE INVENTION

The present invention relates to a trainline support bracket which is normally mounted to a rail car coupler assembly and more specifically to the casting for an end car cushioning coupler assembly. Conventionally, the bracket is mounted to the end car cushioning casting by the use of a bolt which has a nut to secure it in place. In the past, that bolt has sheared off, normally at the root of a thread where the nut attaches to the bolt. When the bolt shears off, it will fall out of the bracket, permitting the coupler pin to drop through the cushion casting, with the result that the coupler will pull out of the end of the car. It had been considered that the problem with the bolt was that there was an unacceptable shear load at the root of the threads where the nut fastened the bolt into the support bracket. The correction which was made was to change the bolt so that there was no likelihood that it would shear at the root of the thread. However, it was not certain that this change would correct the problem or that the problem was in fact shearing at that particular point on the bolt.

The present invention eliminates the problem by positively retaining the bolt in position on the bracket. This is done by a retainer which extends around one of the arms of the bracket and folds over the head of the bolt so that even if the bolt shears off at the area of the nut, the bolt cannot be removed from the bracket as it is positively held in place by the retainer.

SUMMARY OF THE INVENTION

The present invention relates to trainline support bracket and the mounting of such bracket to a rail car coupler assembly.

A primary purpose of the invention is to provide a retainer for use in the described environment which prohibits removal of the mounting bolt, even if a portion of the bolt is sheared off.

Another purpose of the invention is to provide an improved mounting for the trainline support bracket to the coupler end car cushioning casting which prevents the accidental removal of the coupler pin.

Other purposes will appear in the ensuing specification, drawings and claims.

BRIEF DESCRIPTION OF THE DRAWINGS

The invention is illustrated diagrammatically in the following drawings wherein.

DESCRIPTION OF THE PREFERRED EMBODIMENT

Figure 1:
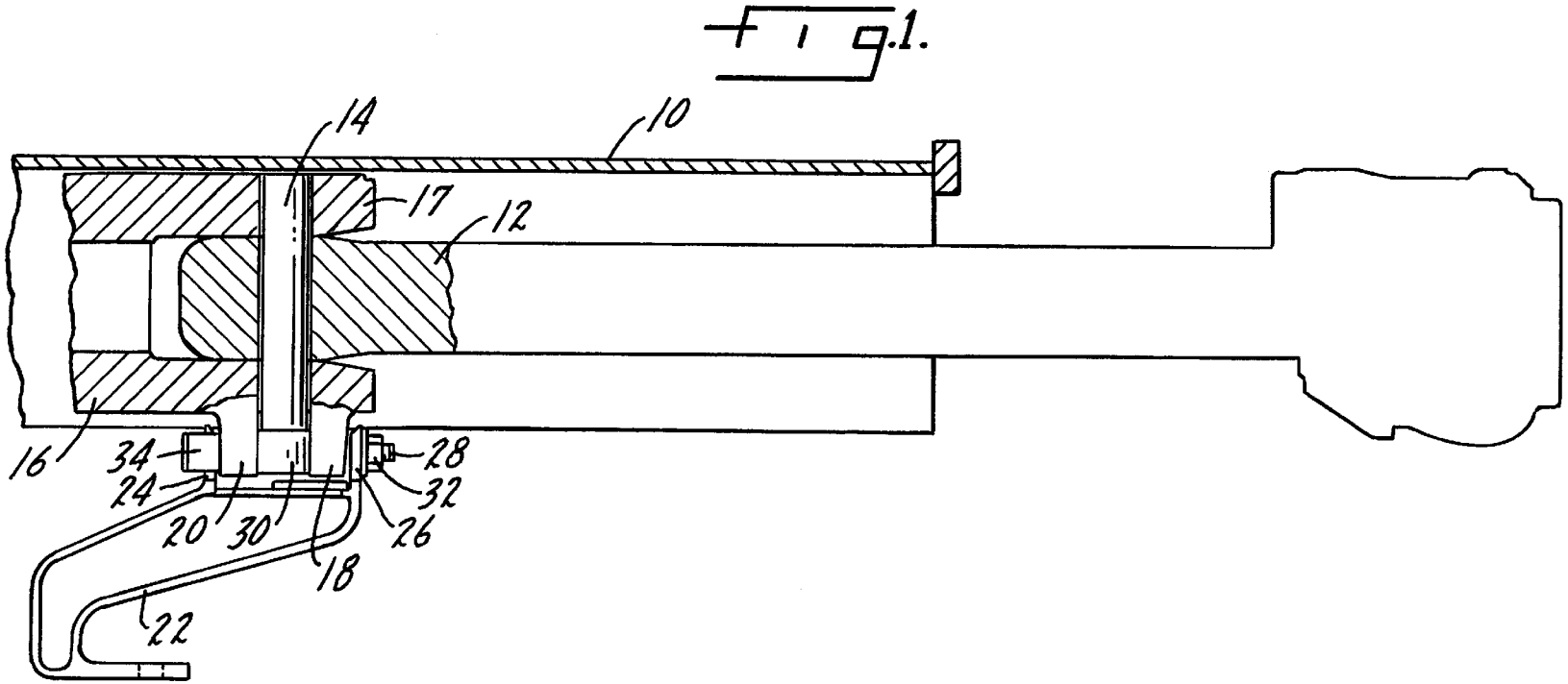
FIG. 1 is a diagrammatic illustration of a portion of a coupler assembly and the mounting of the trainline support bracket thereto.

In FIG. 1, a typical casting for an end car cushioning device is indicated at 10, with the coupler 12 extending outwardly therefrom. The coupler 12 is held in position within the casting by a coupler pin 14 which extends through the coupler 12 and into the bottom portion 16 of the coupler yoke 17. The yoke 17 has a pair of downward extensions 18 and 20 which are used to mount a trainline support bracket 22. Typically, the trainline support bracket 22 will support the air hose, which is connected between adjoining cars. The present invention is specifically concerned with the manner of mounting the bracket 22 to the yoke 17 and this is illustrated in detail in FIGS. 2 and 3.

Figure 2:
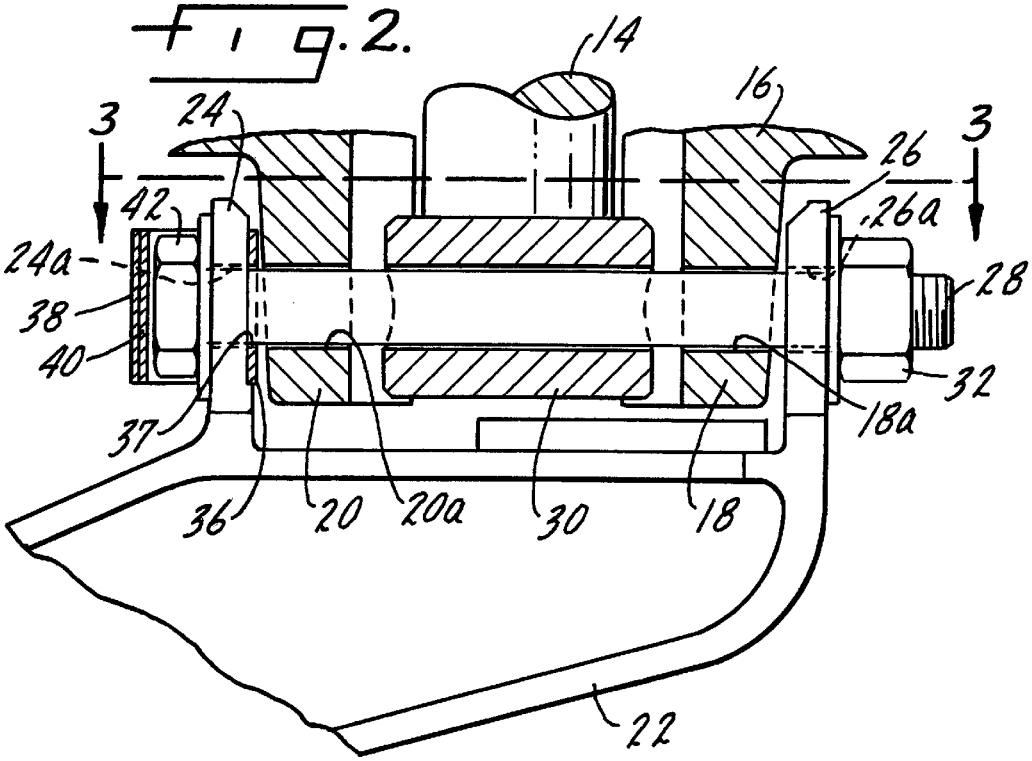
FIG. 2 is an enlarged side view, in part section, of the mounting of the trainline support bracket to a casting of the coupler assembly.
Figure 3:
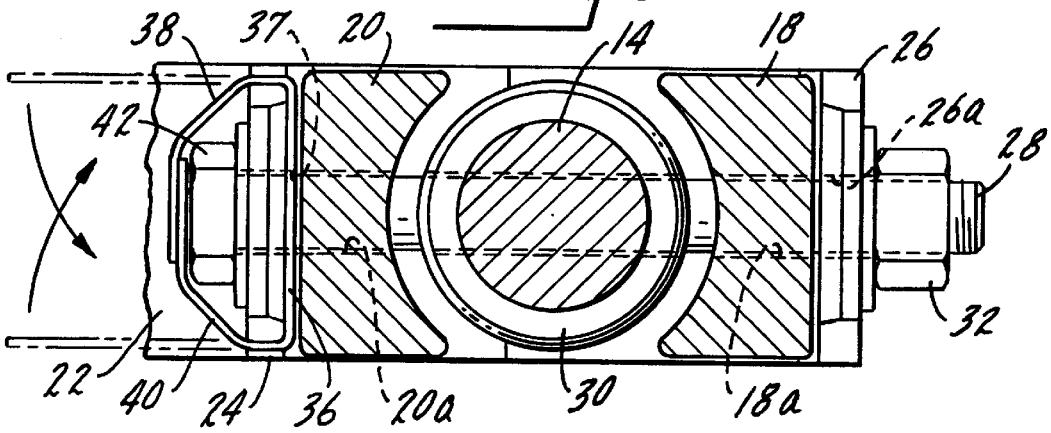
FIG. 3 is a section along plane 3—3 of FIG. 2.

In the past, the specific mounting bolt which connects the trainline support bracket to the yoke 17 has been subject to excessive shear, presumably at the root of the threads where the nut attaches to the bolt. The result of the bolt shearing at this point is that it will fall out of its location as shown in FIGS. 1, 2 and 3, with the end result that the coupler pin 14 will fall out and the coupler will be pulled out of the car resulting in a separation of cars within the train. The present invention is specifically directed to a retainer for holding this bolt in place, even if it should shear.

In FIG. 2, the trainline support bracket 22 has a pair of upwardly-extending arms 24 and 26. Each of these arms has an opening 24*a* and 26*a* for the passage of a bolt 28. The bolt 28 will pass through openings 20*a* and 18*a* in the extensions 18 and 20 and will further pass through a pin retainer 30 beneath the coupler pin 14. Thus, the coupler pin, the bracket 22 and the yoke 17 are all held together by the bolt 28. A nut 32 is threaded onto the end of the bolt. What has been described so far is the prior art method of attaching these elements together.

To avoid accidental removal of the bolt 28, even if it should shear off at the location of the nut 32, a retainer 34 is provided. The retainer may be a steel plate and it has a body portion 36 which is located just inside of arm 24, with the retainer having a pair of tabs 38 and 40 which will be bent around the sides of the arm 24 and extend over, in an overlapping fashion, on the head 42 of the bolt 28.

The retainer body portion 36 has a bolt hole 37. The retainer is applied, in the manner illustrated in FIG. 3, in that it will be slipped over the bolt prior to the time that the bolt is fully positioned to attach the bracket to the casting. Once the retainer has been so positioned and the bolt has been attached with the nut to join these elements, the tabs 38 and 40 will be bent, in the shown overlapping fashion, over the head of the bolt 42. Thus, even if the bolt should be sheared off, adjacent the nut 32, the bolt cannot be accidentally removed from its position in which it passes through the arms 24 and 26 of the trainline support bracket and the extensions 18 and 20 of the yoke and the pin retainer 30 of the coupler pin 14.

Whereas the preferred form of the invention has been shown and described herein, it should be realized that there may be many modifications, substitutions and alterations thereto.

The embodiments of the invention in which an exclusive property or privilege is claimed are as follows:

1. A trainline support bracket and means for mounting the bracket to a rail car coupler assembly, which coupler assembly includes spaced downwardly-directed mounting extensions having aligned bores therein, said bracket and means for mounting including a pair of upwardly-extending arms, spaced apart a distance to be positioned directly outside of said mounting extensions, openings in each of said upwardly-extending arms, which openings are aligned with said extension bores, a headed bolt extending through said aligned bores and openings to attach said bracket to the coupler assembly, a nut threaded on said bolt, the improvement comprising a retainer attached to said bolt and bracket for preventing removal of the bolt from the aligned openings and bores even if the nut is removed from the bolt.

2. The trainline support bracket and mounting of claim 1 wherein said retainer extends around one of said arms and the head of said bolt.

3. The trainline support bracket and mounting of claim 2 wherein said retainer includes a body portion with an opening for the bolt and at least one tab, with the tab extending around said one arm and over the head of said bolt.

4. The trainline support bracket and mounting of claim 3 wherein said retainer has a pair of tabs, each extending around said one arm and over the head of said bolt.

5. The trainline support bracket and mounting of claim 3 wherein the body portion of said retainer is located inside of said one arm.

6. A trainline support bracket and means for mounting the bracket to a rail car coupler assembly, which coupler assembly includes spaced downwardly-directed mounting extensions having aligned bores therein, said bracket and means for mounting including a pair of upwardly-extending arms, spaced apart a distance to be positioned directly outside of said mounting extensions, openings in each of said upwardly-extending arms, which openings are aligned with said extension bores, a headed bolt extending through said aligned bores and openings to attach said bracket to the coupler assembly, a nut threaded on said bolt, the improvement comprising a retainer attached to said bolt and bracket for preventing removal of the bolt from the aligned openings and bores even if the nut is removed from the bolt, said retainer extending around one of said arms and the head of said bolt.

7. The trainline support bracket and mounting of claim 6 wherein said retainer includes a body portion with an opening for the bolt and at least one tab, with the tab extending around said one arm and over the head of said bolt.

8. The trainline support bracket and mounting of claim 7 wherein said retainer has a pair of tabs, each extending around said one arm and over the head of said bolt.

9. The trainline support bracket and mounting of claim 7 wherein the body portion of said retainer is located inside of said one arm.

* * * * *